United States Patent [19]

Rosenblatt

[11] Patent Number: 4,503,682

[45] Date of Patent: Mar. 12, 1985

[54] LOW TEMPERATURE ENGINE SYSTEM

[75] Inventor: Joel H. Rosenblatt, Big Pine Key, Fla.

[73] Assignee: Synthetic Sink, Miami, Fla.

[21] Appl. No.: 473,123

[22] Filed: Mar. 7, 1983

Related U.S. Application Data

[63] Continuation-in-part of Ser. No. 400,464, Jul. 21, 1982, abandoned.

[51] Int. Cl.[3] ..... F01K 25/00

[52] U.S. Cl. ..... 60/671; 60/651; 60/655

[58] Field of Search ..... 60/649, 651, 655, 671, 60/673

[56] References Cited

U.S. PATENT DOCUMENTS

| | | |
|---|---|---|
| 1,782,220 | 11/1930 | Wanamaker et al. . |
| 2,982,864 | 5/1961 | Furreboe . |
| 3,024,366 | 3/1962 | Yanagimachi . |
| 3,413,805 | 12/1968 | Heller et al. . |
| 3,621,653 | 11/1971 | Pacault et al. . |
| 3,795,103 | 3/1974 | Anderson . |
| 4,330,998 | 5/1982 | Nozawa . |
| 4,346,561 | 10/1982 | Kalina . |

FOREIGN PATENT DOCUMENTS

| | | |
|---|---|---|
| 2359813 | 7/1975 | Fed. Rep. of Germany ..... 60/655 |

OTHER PUBLICATIONS

Marks' Handbook, pp. 1212 and 1247–1249, 1941 edition.

Design Handbook of the American Association of Refrigeration Engineers, pp. 5/10–5/15, 1956 edition.

Duffy, "Japanese Pioneer Introduces New Centrifugal Drive Concept", *Air Conditioning, Heating News,* Dec. 18, 1967.

Bjerklie and Luchter, "Rankline Cycle Working Fluid Selection and Specification Rationale", International Automotive Engineering Congress, Jan. 13–17, 1969.

*Primary Examiner*—Stephen F. Husar

[57] ABSTRACT

An improved engine system is provided which includes a synthetic low temperature sink that is developed in conjunction with an absorbtion-refrigeration subsystem having inputs from an external low-grade heat energy supply and from an external source of cooling fluid. A low temperature engine is included which has a high temperature end that is in heat exchange communication with the external heat energy source and a low temperature end in heat exchange communication with the synthetic sink provided by the absorbtion-refrigeration subsystem. By this invention, it is possible to vary the sink temperature as desired, including temperatures that are lower than ambient temperatures such as that of the external cooling source. This feature enables the use of an external heat input source that is of a very low grade because an advantageously low heat sink temperature can be selected.

18 Claims, 3 Drawing Figures

LOW TEMPERATURE ENGINE SYSTEM

BACKGROUND AND DESCRIPTION OF THE INVENTION

This is a continuation-in-part of application Ser. No. 400,464, filed July 21, 1982, now abandoned.

The present invention generally relates to engine systems, more particularly to engine systems that operate at generally low temperatures when compared with high pressure and high temperature engine systems, such as high pressure turbines that are used in facilities including steam turbine power plants in association with a low temperature turbine. The low temperature engine system, which may replace such a low temperature turbine, incorporates a synthetic heat sink that can provide a flow of cooling fluid having a temperature lower than a typical external cooling source at ambient temperature.

In response to the growing recognition of the nonrenewability of fossil fuel resources, attention has been increasingly directed toward a variety of technologies having the potential of development of lower grade energy sources, such as solar energy, ocean thermal gradient energy, geothermal energy potentials, and systems capable of employing biomass and other low grade, but renewable, fuel sources. Less public attention has been given to utilization of the quantity of waste heat energy being discharged to the environment in processes which consume high grade fuels. It would, of course, be desirable to increase the efficiency of systems that consume high grade fuels, or for that matter of those that use the lower grade energy sources, in order to thereby conserve these natural resources.

One approach for enhancing such efficiency involves converting otherwise-wasted heat energy into usable energy such as electricity. For example, in the electric utility industry, substantial quantities of heat are wasted by being discharged from the condensers of steam turbines. Moreover, indiscriminate entry of this waste heat into the environment has created significant concerns regarding thermal pollution. Over the years, efforts have been made in attempting to recover a portion of this heat energy. Past efforts include systems having combined gas turbine/steam cycles and systems that incorporate binary vapor Rankine cycles which comprise engine systems having bottoming cycle low temperature turbines added in tandem to the discharge end of steam turbine cycles.

Efforts along these lines include discharging the waste heat from a simple steam turbine cycle directly to an available ambient temperature "sink", such as a large body of water. Although these efforts include discharging at the lowest practical condensing pressures or high vacuum conditions, typically on the order of one inch Hg, it is still necessary to discharge the remaining heat of condensation, which is often greater than twice the available heat that is actually converted to useful output power by the turbine in the cycle.

Attempts have been made to improve on this situation by modifying the low temperature portion of the cycle by using a halogenated carbon refrigerant as the thermodynamic medium, rather than steam. This approach considerably improves the overall thermodynamic efficiency of the total system, while also eliminating the need for the high vacuum condenser pressures that are otherwise provided. The overall thermodynamic efficiency is improved because the refrigerant vapor is at a temperature lower than that of steam, which means that the waste heat discharged when liquifying the thermodynamic medium is reduced in relationship to the unit heat available in the cycle.

Even though this approach amounts to a substantial improvement, efforts to further increase the efficiency of such systems are limited by the fact that the maximum peak temperature available to the low temperature turbine is inherently limited by the temperature of the low grade heat source being tapped as the heat input supply and because the minimum temperature at the bottom end of the cycle is dictated by that of the naturally occurring cooling source, which cannot be controlled. This limits the theoretical maximum potential efficiency of any of these systems, since such efficiency is defined in terms of Carnot cycle efficiency which is a function of the temperature differential between that of the heat source, or top end of the cycle, and the bottom end of the cycle, or heat "sink" provided by the naturally occurring body of fluid.

Certain prior efforts have attempted to increase the Carnot cycle temperature differential by discharging the waste heat into a sink that is not naturally occurring and that has a temperature lower than that of a naturally occurring body. These efforts have attempted to rely upon the advance preparation of a cold cooling reservoir and placing same in storage until the refrigerated fluid needs to be withdrawn from storage for use in lowering the condenser temperature. Often, vapor compression refrigeration is employed in this regard, which typically requires more input shaft power to effect the cooling needed to provide the sink than is made available as increased shaft power output, which results in limited efficiency increases. These efforts can be characterized as "batch" systems wherein energy is stored for later use; however, the amount of energy recovered from such storage will usually be less than the amount of energy consumed to effect the storage.

Accordingly, there are substantial benefits to be gained in providing a sink for heat discharge in connection with a low temperature engine, which sink can be varied in temperature, most advantageously to temperatures below those of typically available natural bodies. Further and very significant advantages would be gained if this sink could be provided in a form other than that of a stored batch of energy.

Such objectives are accomplished according to the present invention by providing a low temperature engine system that includes a continuous-flow synthetic sink which is developed simultaneously with the operation of the engine system. The only needed external inputs are those of a low grade heat source and a source of fluid at ambient temperature. The low temperature engine system according to this invention includes a low temperature engine which is in heat exchange communication with said low grade heat energy input. The low temperature heat engine is also in heat exchange communication with an absorbtion-refrigeration subsystem that includes an absorber assembly which is in heat exchange communication with the external cooling source at ambient temperature. The temperature of heat exchange between the continuous-flow synthetic sink and the low temperature heat engine is below that of the ambient temperature of the external cooling source.

It is accordingly an object of the present invention to provide an improved low temperature engine system.

Another object of this invention is to provide an engine system that is generally independent of the availability of a stored auxiliary energy system.

Another object of the present invention is to provide a continuous-flow synthetic sink that consumes energy at a lower rate than the increased power output yield resulting from its use in conjunction with an overall low temperature engine system.

Another object of the present invention is to provide an engine system that is useful in responding to concerns regarding thermal pollution.

Another object of this invention is to provide a low temperature engine system having an increased low temperature turbine output and decreased rotating machinery and capital cost.

Another object of this invention is to provide an engine system which includes a regenerative exchange of heat and cooling between its engine cycle and its refrigeration cycle to reduce net consumption of energy in the refrigeration cycle to the point that its net energy input demand is lower than that needed to offset the advantage in increased output to the turbine cycle that its use creates.

Another object of this invention is to provide an engine system that combines various components thereof in order to achieve interactions therebetween which enhance the overall efficiency of the engine system.

Another object of this invention is to provide an improved low temperature engine system that incorporates an absorbtion-refrigeration subsystem which operates with little or no input shaft power needs and which uses heat energy as the input energy source.

Another object of the present invention is to provide an improved low temperature engine system which incorporates a continuous-flow synthetic sink having a sink temperature lower than ambient, which sink temperature may be selected as a variable design parameter.

These and other objects, features and advantages of the present invention will be clearly understood through a consideration of the following detailed description, including the following drawings, wherein.

Figure 1:
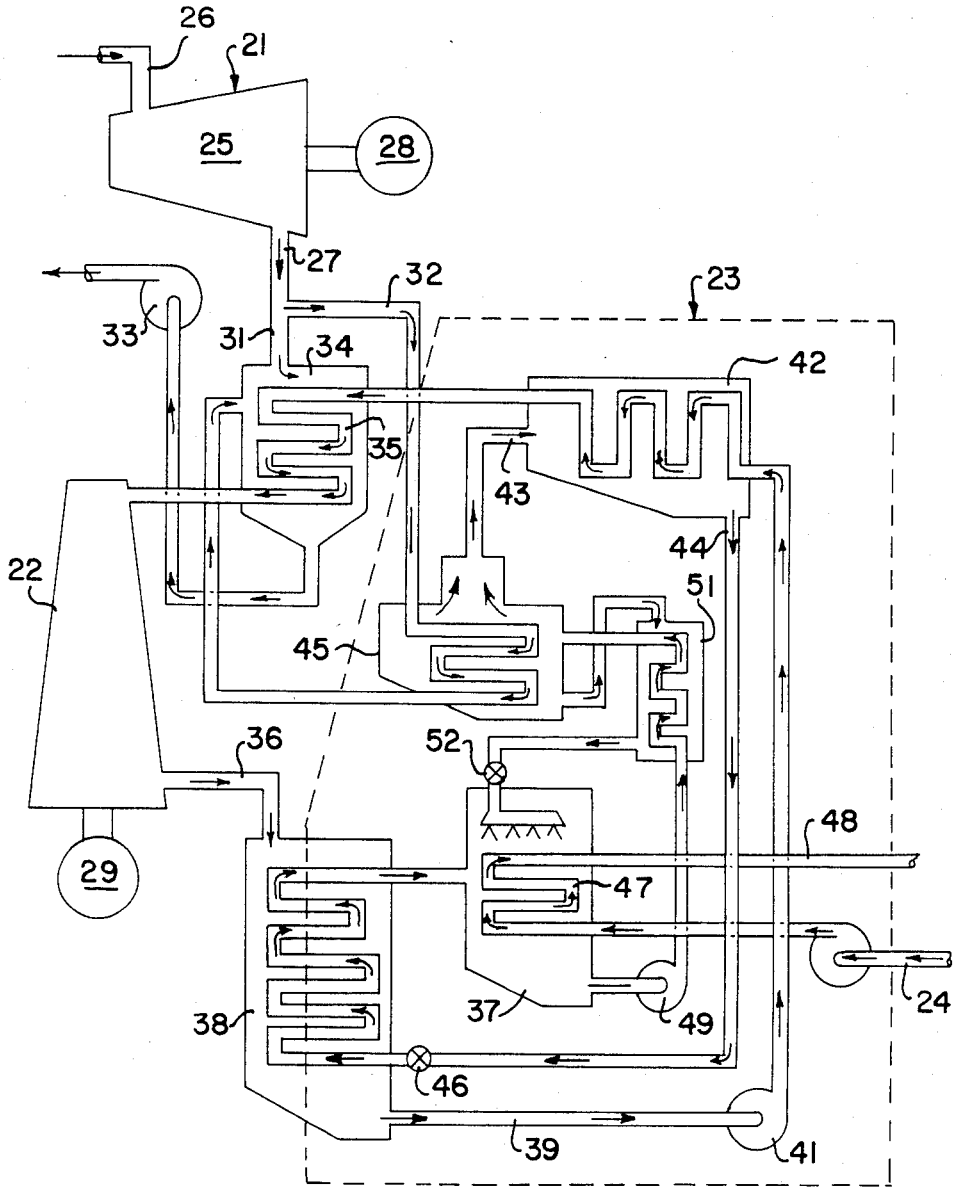
FIG. 1 is a schematic, elevational view illustrating an embodiment of the low temperature engine system according to this invention.

The low temperature engine system according to the present invention includes a low grade heat energy input supply, generally designated as 21 in the drawings, a low temperature heat engine 22, and an absorbtion-refrigeration subsystem, generally designated as 23, 23*a*, 23*b*. An external cooling source 24 is in heat exchange communication with the absorbtion-refrigeration subsystem. The external cooling source 24 typically will ultimately originate with a large body of water, although other arrangements, usually mechanically assisted, may likewise be included in providing an external cooling source 24.

The low grade heat energy input supply 21 may be any one of a number of heat sources that provides a source of heat at a temperature higher than the temperature that the thermodynamic medium of the low temperature heat engine 22 enters the heat engine 22 at the appropriate pressure. Such supplies 21 include the output of a solar collector system, heated cooling water from a variety of industrial processes, low grade fuel combustion, and the like.

For convenience and for purposes of illustration, the low grade heat energy supply 21 is illustrated herein as the waste heat discharge from another heat engine cycle that is operating at a temperature higher than the low temperature engine system of this invention. In this connection, the low grade heat energy input supply 21 is illustrated in the drawings as a steam turbine 25 having a high temperature and pressure steam input 26, and a steam exhaust 27 through which steam passes after its pressure and temperature has been lowered by the work performed in operating the steam turbine 25 for driving an electric power alternator 28 or the like.

Also for purposes of illustration, the low temperature heat engine 22 is shown as a power turbine operating on a closed Rankine cycle which, unlike the steam turbine 25, utilizes a thermodynamic medium other than steam, such as a halogenated carbon refrigerant, iso-butane, ammonia, and combinations thereof. The illustrated low temperature heat engine 22 drives an electrical power alternator 29 or the like.

The absorbtion-refrigeration subsystem 23 synthesizes a continuous-flow sub-ambient temperature heat sink simultaneously with and in conjunction with the discharge of heat from the low grade heat energy input supply 21 through the steam exhaust 27.

Absorbtion-refrigeration subsystem 23 includes a liquor that consists of a mixture of an absorbent and a refrigerant. Often, this absorbent-refrigerant liquor is a combination of two fluids, one having particularly useful absorbtion properties, and the other having refrigeration properties. Water is often used as the absorbent. Other absorbents include dimethyl ether of tetraethylene glycol, lithium bromide and the like. Refrigerants include ammonia, water, and halogenated hydrocarbons. The particular absorbent-refrigerant liquor may vary from one particular low temperature engine system to another. Determining which choice is appropriate will include considerations such as the intended peak temperature of the heat input source, the intended low temperature of the sink condition being synthesized, characteristics of the external cooling source 24, desired operating pressure regimens within the system, and considerations such as liquor toxicity, corrosiveness and flammability, as well as economic considerations.

In all of the embodiments of this invention, the engine cycle which incorporates the low temperature heat engine 22 and the absorbtion-refrigeration cycle which incorporates the absorbtion-refrigeration subsystem 23 interact with each other, primarily through heat exchange interrelationships, in order to accomplish efficiencies of interaction which are further combined with the heat energy properties provided by the low grade heat energy input supply 22 and by the external cooling source 24.

More particularly, within the absorbtion-refrigeration subsystem 23, the cooled heat engine medium is to be immediately reheated for repeating its cycle as a heat engine medium. The cold medium from the low temperature heat engine serves as a coolant for the waste heat discharged by the absorbtion-refrigeration subsystem 23 by being recycled therethrough. By these various interactions, heat energy is transferred within the overall low temperature engine system, and the waste heat being discharged is significantly reduced. All of this is accomplished while simultaneously providing a synthetic sink that is at a temperature lower than ambient in order to adjust the temperature differential between the heat input temperature and the heat rejection temperature.

Steam passes through the steam exhaust 27 in order to provide the heat input to the low temperature engine system according to this invention, the heat input being to both the low temperature heat engine cycle and the absorbtion-refrigeration subsystem cycle. This is accomplished in the embodiments shown in FIGS. 1 and 2 by dividing the steam exhaust conduit into two lines 31 and 32. After this steam completes the heat exchange communications, such is cooled, and typically condensed as it exits the low temperature engine system through a return pump 33 for return to the steam boiler (not shown).

With more particular reference to the heat exchange communication between the steam turbine 25 and the low temperature heat engine cycle, steam from the steam turbine 25 enters a steam condenser 34 which includes suitable heat transfer members 35 through which the thermodynamic medium of the low temperature heat engine 22 circulates as a portion of the flow path for the low temperature heat engine cycle. This particular heat exchange communication completes the increase of the temperature of the heat engine thermodynamic medium before it enters the low temperature heat engine 22.

The thus heated and pressurized thermodynamic medium expands through the low temperature heat engine 22 to a condition of lower pressure and substantially lowered temperature which is considerably below the ambient temperature of the external cooling source 24. When the thermodynamic medium leaves the low temperature heat engine 22 through exit port 36, it is a cold, low-pressure vapor that is suitable for entry into the absorbtion-refrigeration subsystem 23.

Figure 2:
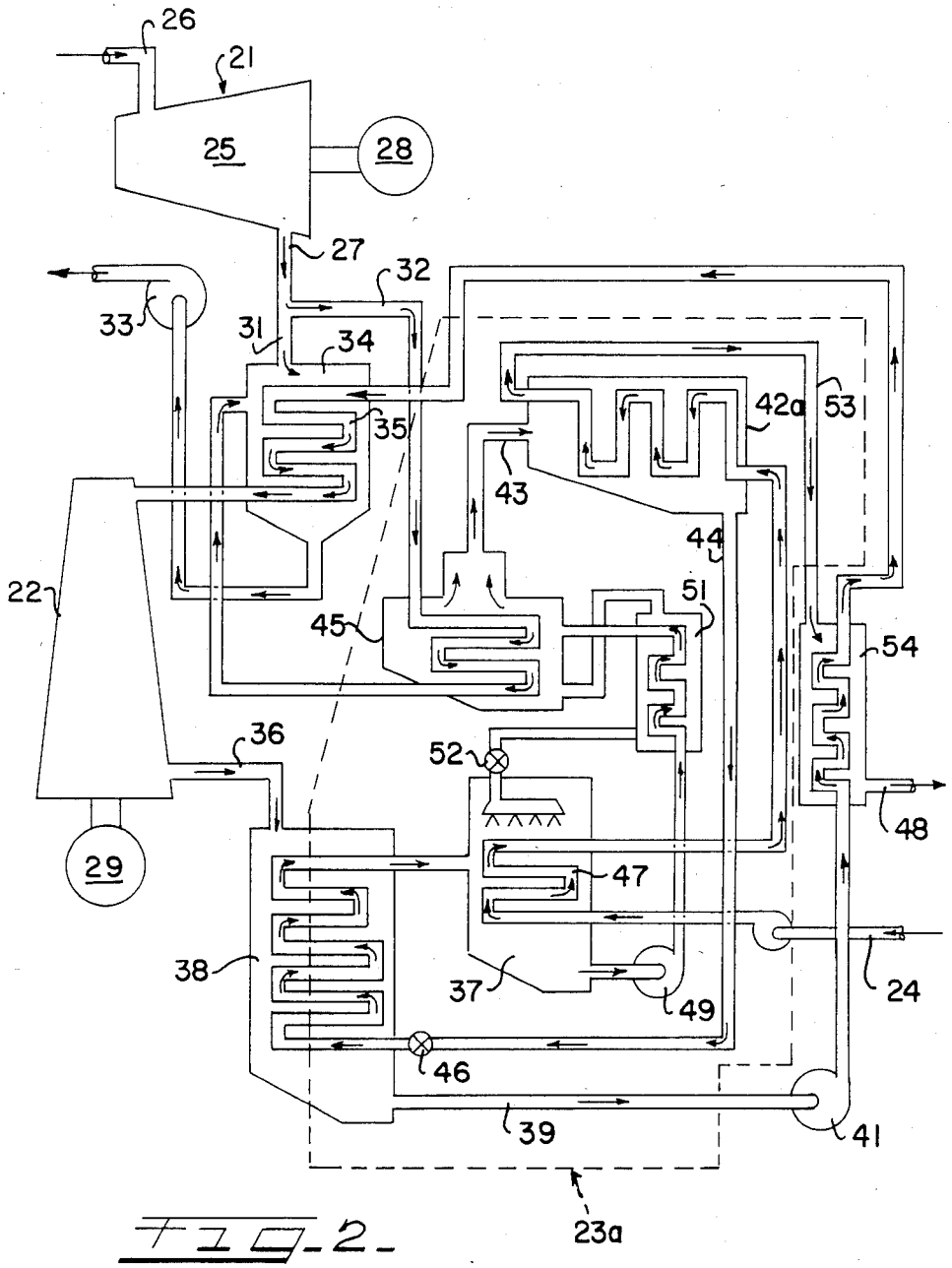
FIG. 2 is a schematic, elevational view illustrating another embodiment of this invention which provides even further minimization of net waste heat rejection into the environment.

In the embodiments of FIGS. 1 and 2, this heat exchange communication is with an absorber unit 37 in heat exchange communication through a condenser-/evaporator 38. Within the condenser/evaporator 38, the thermodynamic turbine medium cold vapor yields heat to be condensed to its liquid phase by the time it leaves the condenser/evaporator 38 and passes through exit conduit 39. The heat that is yielded by the thermodynamic turbine medium is imparted to the refrigerant of the absorbtion-refrigeration subsystem 23.

Referring especially to the embodiment of FIG. 1, after the liquid thermodynamic medium passes through exit conduit 39, it is circulated, typically with the assistance of a pump 41, for passage to a heat exchanger or condenser 42 in order to provide regenerative heating to the thermodynamic medium, which increases the temperature thereof. Such increasing of the temperature is furthered when the thermodynamic medium later passes through the heat transfer members 35 of the steam condenser 34 in order to complete the heat engine cycle. In addition to providing regenerative energy to the thermodynamic medium, the heat exchange communication of the condenser 42 cools the refrigerant flowing therethrough, typically to the extent that refrigerant entering the condenser 42 as a vapor at entrance port 43 leaves in a liquid state through outlet 44.

With more particular reference to details of the absorbtion-refrigeration subsystem 23, this particular embodiment includes the absorber 37, the condenser-/evaporator 38, the heat exchanger or condenser 42, and a generator 45. Heat is input to the absorbtion-refrigeration subsystem 23 from the low grade heat energy supply 21 through line 32 as previously described. This extraction steam is used to heat the contents of the generator 45, and the cooler steam vapor is returned to steam condenser 34, if desired, in order to complete its condensation before its passage through the return pump 33. This heat input to the generator 45 fractionally distills the refrigerant of the absorbent-refrigerant liquor within the generator 45. Such vaporized refrigerant then passes to the condenser 42 in order to carry out the heat exchange previously described whereby the vaporized refrigerant is liquified as it leaves through outlet port 44 and the thermodynamic medium is increased in heat and temperature as it flows through the condenser 42.

Refrigerant passing through the outlet port 44, although now a liquid, is still at an elevated pressure for passage through an expansion valve 46. The expansion valve 46 drops the pressure of the liquid refrigerant in order to facilitate a flash vaporization thereof as it enters the condenser/evaporator 38 at the temperature required to synthesize the sink conditions imparted to the thermodynamic medium as it flows through the condenser/evaporator 38. When the refrigerant leaves the condenser/evaporator 38 and enters the absorber 37, the refrigerant has absorbed the heat of condensation rejected by the thermodynamic medium, and its temperature is slightly elevated from its temperature after leaving the expansion valve 46.

Within the absorber 37, the refrigerant mixes with, preferably by meeting the spray of, warm absorbent-weak liquor of the absorbent-refrigerant liquor. By this mixing, the refrigerant and the absorbent are combined as the absorbent-refrigerant liquor that is at a temperature greater than that provided to the absorber 37 by the external cooling source 24, typically by means of heat transfer elements 47, whereby the absorbent-refrigerant liquor is lowered in temperature to a temperature equal to or slightly greater than that of the external cooling source 24, while the cooling fluid is returned to the external cooling source 24 by a return conduit 48. This feature of cooling the absorbent-refrigerant liquor in the absorber 37 facilitates the process of solution formation, and higher concentrations of refrigerant are dissolved within the absorbent than would otherwise occur in an environment that is not so cooled.

The formed strong absorbent-refrigerant liquor is transported, typically with the assistance of a refrigeration circulating pump 49, to a supplemental heat exchanger 51 where it is warmed by hot, weak liquor absorbent flowing from the generator 45 after fractional distillation therewithin of this absorbent-refrigerant liquor back into the vaporized refrigerant and the heated, liquid absorbent. The elevated pressure imparted to the heated absorbent within the generator 45, which assists its passage through the supplemental heat exchanger 51, is reduced to the lower operating pressure of absorber 37 by passing through pressure reducing valve 52.

This completes the absorbtion-refrigeration cycle, wherein fluids within the condenser 42 and the generator 45 are at an elevated pressure, while fluids within the absorber 37 and the condenser/evaporator 38 are at a reduced pressure. Revisions to the absorbtion arrangement can be effected should a more constant pressure be desired. With the cycle thus completed, the heat of condensation of the refrigerant within the absorbtion-refrigeration cycle is not rejected externally of the low temperature engine system, but it is used for regenerative heating of the thermodynamic medium.

FIG. 2 illustrates an embodiment which makes it possible to even further reduce the net waste heat rejected from the low temperature engine system according to this invention, particularly the waste heat rejected through the return conduit 48. Under proper conditions, it is possible for the cooling fluid returned to the external cooling source 24 to more closely approximate the temperature of the external cooling source 24 itself. Such is accomplished by increasing the heat exchange interaction of the cooling fluid with the absorbtion-refrigeration subsystem 23 and by adding heat exchange interaction thereof with the thermodynamic medium. This embodiment is facilitated when the cooling capacity of the thermodynamic medium, after it passes out of the condenser/evaporator 38, through the conduit 39, the pump 41 and into the condenser 42, is greater than that needed to condense the refrigerant within the condenser 42. Under these circumstances, this excess cooling capacity of the thermodynamic medium can be employed to collect additional regenerative heat from the amount of heat energy that might otherwise be rejected from the system as waste heat through return conduit 48.

In the embodiment illustrated in FIG. 2, the absorbtion-refrigeration subsystem **23*a* includes additional and varied heat transfer locations with respect to the refrigeration portion of this subsystem. More particularly, after the fluid from the external cooling source 24 leaves the absorber 37, it is directed to the condenser 42*a* in order to cool the refrigerant vapor therein. By this procedure, the cooling fluid leaving the condenser 42*a*** includes most of the waste heat being rejected by the entire system.

This waste heat containing fluid then flows through a transfer conduit 53 to a regenerative heat exchanger 54, wherein the waste heat containing fluid is cooled by the thermodynamic medium which is routed therethrough on its flow path between the condenser/evaporator 38 and the steam condenser 34. By this operation, a substantial quantity of the waste heat within the cooling fluid will be retained within the flow temperature engine system, and the cooling fluid leaving through the return conduit 48 will be a temperature that is not substantially different from that of the external cooling source 24 itself. This permits greater effective control of the temperature at which waste heat leaves the low temperature engine system.

Figure 3:
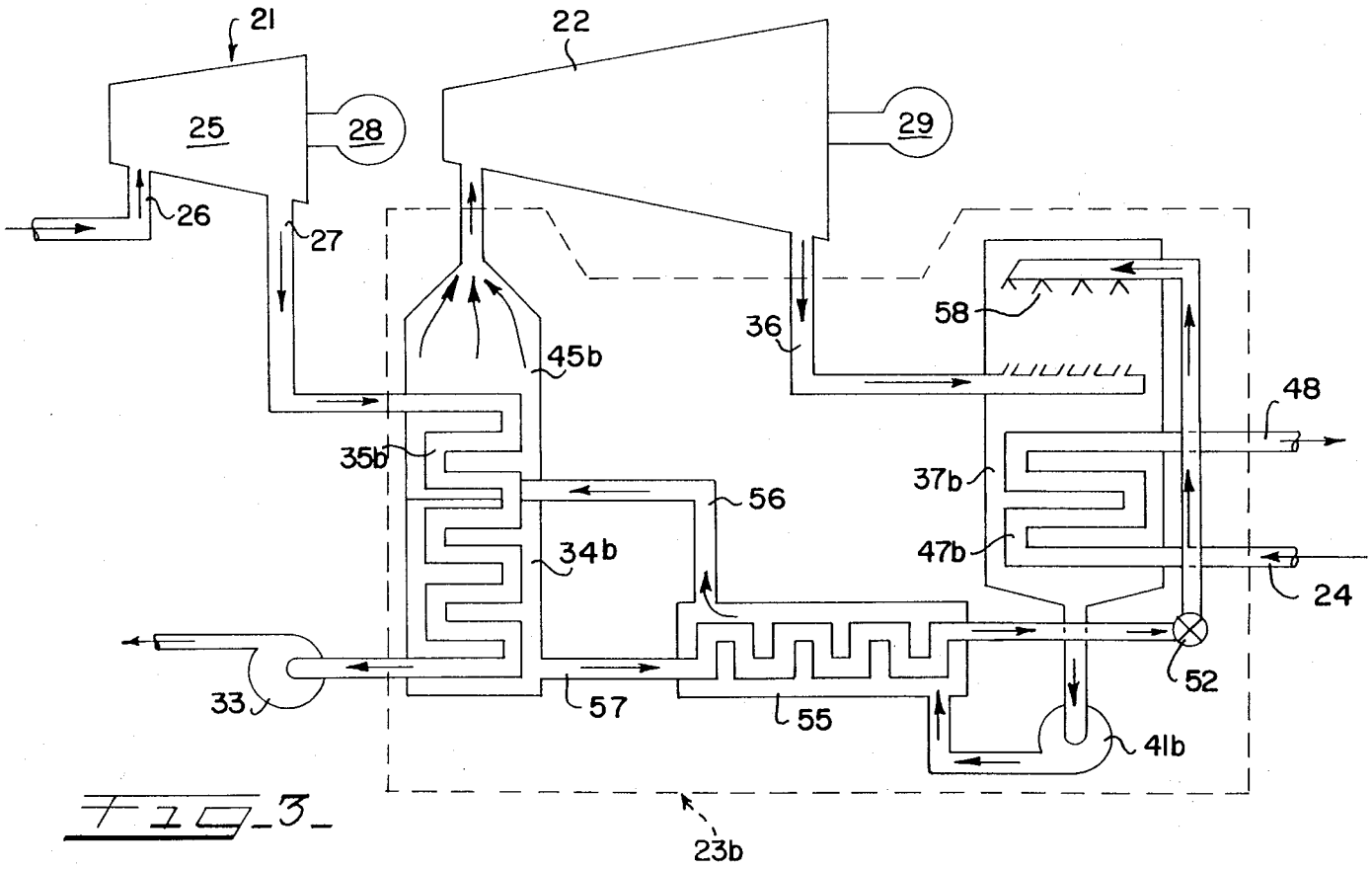
FIG. 3 is a schematic, elevational view illustrating yet a further embodiment of this invention in which certain aspects thereof are integrated together.

FIG. 3 illustrates another embodiment of this invention wherein certain elements of the absorbtion-refrigeration subsystem **23*b* are integrated with engine cycle functions. Heat input to the low temperature engine system is provided by the low grade heat energy input supply 21 through steam exhaust 27 into the generator 45*b* and into the steam condenser 34*b*. The spent steam is returned to the boiler through the return pump 33**.

In this embodiment, the thermodynamic medium and the refrigerant constitute a common fluid that flows through the low temperature heat engine 22 and through the absorbtion-refrigeration subsystem **23*b*. The absorbent of the absorbtion-refrigeration subsystem 23*b*** may include the same components as the refrigerant, typically in a more diluted form. Because these various liquids flow into each other, it is appropriate to view same in terms of a strong liquor and a weak liquor, with the strong liquor, or refrigerant-thermodynamic medium liquor, having a greater concentration of the refrigerant than the weak liquor or absorbent. A typical liquor can include ammonia as the refrigerant-thermodynamic medium and water as the absorbent.

Strong liquor within the generator **45*b* is heated by the steam flowing through the heat transfer members 35*b*, at which time the strong liquor is fractionally distilled to drive off the refrigerant-thermodynamic medium at a high temperature and pressure for expansion through and driving of the low temperature heat engine 22. When the vapor phase of the refrigerant-thermodynamic medium passes through the exit port 36 to the absorber 37*b***, its pressure is lowered, and its temperature is generally cold.

In the absorber **37*b*, the cold vapor enters and mixes, for example by spraying, with the returning weak liquor, entering the absorber 37*b*, resulting in the formation of a somewhat cool, somewhat more concentrated strong liquor. This liquor is further cooled by a flow from the external cooling source 24 flowing through the heat transfer elements 47*b*, and out through the return conduit 48. This cold strong liquor is then repressurized by the pump 41*b*, at which point this strong liquor becomes a pressurized cold fluid entering a heat exchanger 55, within which the strong liquor is heated prior to its return to the generator 45*b* through a conduit 56**.

Within the generator **45*b*, as the fractional distillation proceeds, the weak liquor falls into the steam condenser 34*b* and leaves same through exit 57 as a flow of hot weak liquor to and through the heat exchanger 55 for heating the strong liquor flowing therethrough. The weak liquor leaves the heat exchanger 55 at a lower temperature than it enters. It is preferably passed through a pressure reducing valve 52 before it enters the absorber 37*b*, such as through spray heads 58**.

The following specific examples will more precisely illustrate this invention and teach the presently preferred procedures for practicing the same, as well as the advantages and improvements realized thereby.

EXAMPLE I

A low temperature engine system in accordance with FIG. 1 includes a halogenated carbon, Freon 22 (trademark), as the thermodynamic medium within the low temperature heat engine cycle, and an ammonia and water mixture as the absorbent-refrigerant liquor. The temperature at the condenser is 22° F., with the pressure thereat for the thermodynamic medium being 23.7 psia.

The absorbtion-refrigeration subsystem provides a synthetic sink temperature of 27° F. Steam is supplied from a conventional high-pressure steam turbine such that the peak temperature for the low-temperature turbine of the engine system is 205° F. The external cooling source is 70° F. cooling tower water.

The high pressure turbine providing the low grade heat energy input supply is that of a basic conventional steam power plant having cycle details as presented in *Fundamentals of Classical Thermodynamics*, Van Wylen and Sonntag, John Wiley & Sons, 1968, page 280. Its own heat pressure cycle can be summarized as follows: steam enters the high pressure turbine at 1265 psia and 955° F., 9% of steam is extracted at 330 psia at a first extraction point, 9% of steam is extracted at 130 psia at a second extraction point, 3.4% of steam is extracted at 48.5 psia at a third extraction point, and the steam exits at atmospheric pressure. This cycle provides approximately 280.5 BTU per pound of steam leaving the boiler to mechanical shaft power.

In the generator of the low temperature engine system, the weak liquor is 30% ammonia at a temperature of 210° F. and a pressure of 135 psia. In the absorber, the strong liquor is 35% ammonia at 75% and 15 psia. The specific heat of the liquor is about 1.05 BTU/lb./° F. At the supplemental heat exchanger 51, the entering weak liquor from the generator 45 is at about 210° F., while the entering strong liquor from the absorber 37 is at about 75° F., and the weak liquor exits therefrom at a temperature of 80° F. With 14.0 pounds of weak liquor in the system, the heat transferred from the weak liquor 1,774.5 BTU, meaning that the temperature rise of the strong liquor is 120.7° F. Thus, the temperature of the strong liquor entering the generator 45 is about 195.7° F.

Within the generator 45, 1.052 pounds of steam heat energy are needed as input to liberate each pound of ammonia in the generator 45. In the condenser-/evaporator 38, the temperature difference between the thermodynamic medium and the ammonia is 5° F., with the ammonia evaporation condition being 27.7° F. and 15 psi and the thermodynamic medium condensation condition being 22° F. and 23.7 psia. The total heat absorbtion or refrigeration capacity of the ammonia is 691.6 BTU per pound, and about 8.05 pounds of the thermodynamic medium are condensed per pound of ammonia.

In the heat exchanger or condenser 42, the temperature differential between the exiting ammonia liquid and the entering thermodynamic medium liquid is 5° F., and the heat transferred to the thermodynamic medium in this condenser 42 is 287.7 BTU.

Within the superheater or steam condenser 34, the thermodynamic medium exiting therefrom is at 205° F. and 540 psi pressure. The exit condition of the thermodynamic medium from the pump 41 is 22° F. at 540 psi, meaning that the total heat input to the thermodynamic medium required is about 116.1 BTU per pound, or about 934.6 BTU for the 8.05 pounds of thermodynamic medium. Accordingly, the heat input required by the superheater 34 is 934.6 minus 287.7 BTU, or about 646.9 BTU, which consumes about 0.827 pounds of steam within the superheater. Combining the total steam input needed for the superheater and for the heat needed to liberate the ammonia in the generator 45, the total steam input needed is 1.879 pounds.

With the thermodynamic vapor at the point of entry of the turbine 22 being 205° F. at 540 psia and at the exit being 22° F. at 23.7 psia, the total turbine yield is about 30.21 BTU per pound of thermodynamic medium, or about 243.2 BTU for approximately 8.05 lbs. of the thermodynamic medium per 1.879 pounds of steam. Thus the yield at the turbine per pound of steam leaving the boiler of the high temperature turbine is 243.2 BTU divided by about 1.879 pounds of steam, or about 129.4 BTU.

Accordingly, the total output for both the high pressure turbine and the low temperature engine system according to this Example is 409.9 BTU per pound of steam to the high pressure turbine, 280.5 BTU from the high pressure turbine and 129.4 BTU from the low temperature engine system according to this invention.

COMPARISON A

In order to illustrate the advantages obtained by this invention, comparison is made with a low temperature unit including a low pressure turbine having entering steam at 220° F. and 14.8 psia, with a fourth extraction point of steam in the total high pressure and low pressure turbines at 7.7% of steam extracted at 10.8 psia. Steam exits the low pressure turbine and enters the standard condenser at a condenser pressure of 1.5 inch Hg absolute. In this conventional cycle, 33.5 BTU per pound of steam leaving the boiler are converted to shaft power by the low pressure steam turbine, making the total output for this "all steam" conventional system at 280.5 BTU plus 33.5 BTU, or a total of 314 BTU per pound of steam generated. This is the complete system specified in *Fundamentals of Classical Thermodynamics*, supra. Accordingly, the 409.9 BTU per pound of total system output provided by the system according to this invention in this Example represents a 30.55% improvement over the 314 BTU per pound provided by this conventional system.

COMPARISON B

A further illustration for comparative purposes is the use of a low pressure turbine with a conventional binary cycle employing the same "bottoming cycle" using a thermodynamic medium as Example I Freon 22 (trademark). Such receives its heat input directly from the steam exhaust leaving the high pressure steam turbine at a temperature of approximately 222° F. and a pressure of 14.7 psia. The bottoming cycle then operates using this thermodynamic medium at a turbine entry pressure of 540 psia and a temperature of 205° F. and exhaust to its condenser at a pressure of 183.1 psia and a temperature of 90° F. This is the equivalent condenser exit temperature as that made available to the steam low pressure turbine of Comparison A, based on a supply of 70° F. cooling water to the condenser from a cooling tower. This results in a low pressure turbine output of about 105.5 BTU per pound of steam leaving the boiler to the high pressure steam turbine, or a total of 386 BTU per pound for the combined low temperature turbine and high pressure turbine, representing an output improvement 22.91% when compared with the all steam system of Comparison A. The system according to this invention in this Example had an output advantage over this Comparison B system of about 3.74%.

The foregoing Examples are offered to illustrate the system according to this invention. They are not intended to limit the general scope of this invention in strict adherence thereto; accordingly, the invention is to be construed and limited only by the scope of the appended claims.

What is claimed is:

1. An improved low temperature engine system, comprising:

means for supplying a flow of heat energy input to the low temperature engine system;

an absorbtion-refrigeration subsystem having a circulating absorbent-refrigerant liquor for receiving and for synthesizing and imparting to a condenser a continuous-flow low temperature heat sink at a selected temperature;

a low temperature heat engine having a power turbine and a circulating thermodynamic medium in heat exchange communication with said heat energy input means and in heat exchange communication at said condenser with said absorbtion-refrigeration subsystem, said low temperature heat engine operating across a thermal gradient having a high temperature end of flowing thermodynamic medium that is in heat exchange communication with said heat energy input means, said low temperature heat engine has a low temperature end through which the thermodynamic medium flows before heat exchange communication thereof with said synthesized continuous-flow low temperature heat sink of the absorbtion-refrigeration subsystem, and said thermodynamic medium has a vaporization temperature lower than that of steam at the same pressure and a melting point temperature lower than that of water;

an external cooling source for providing a cooling fluid in heat exchange communication with said absorbent-refrigerant liquor; and said heat exchange communication at said condenser between the circulating thermodynamic medium and the absorbtion-refrigeration subsystem is carried out without the need for providing said cooling fluid to said condenser.

2. The engine system of claim 1, wherein said external cooling source is at an ambient temperature and said selected temperature of the low temperature heat sink is at a temperature below said ambient temperature.

3. The engine system of claim 1, wherein said heat energy input means provides a source of heat at a temperature higher than that at which the thermodynamic medium enters said low temperature heat engine.

4. The engine system of claim 1, wherein said heat energy input means is the exhaust from a steam turbine.

5. The engine system of claim 1, wherein the refrigerant vapor circulating through the absorbtion-refrigeration subsystem provides the low temperature high sink to the circulating thermodynamic medium and the circulating refrigerant alternately supplies heat to the circulating thermodynamic medium.

6. The engine system of claim 1, wherein the refrigerant flowing through the absorbtion-refrigeration subsystem is in heat exchange communication with condenser/evaporator means for condensing engine thermodynamic medium and for evaporating the refrigerant.

7. The engine system of claim 1, wherein said absorbtion-refrigeration subsystem includes condenser means that increases the temperature of the engine thermodynamic medium circulating therethrough prior to its entry into the low temperature heat engine, said condenser means also decreases the temperature of refrigerant circulating therethrough.

8. The engine system of claim 1, wherein said absorbtion-refrigeration subsystem further includes generator means for separating the absorbent-refrigerant liquor into a weak absorbent liquor flow and a refrigerant flow.

9. The engine system of claim 1, wherein said absorbtion-refrigeration subsystem includes generator/condenser means for receiving heat energy from said heat energy input means and for separating the absorbent-refrigerant liquor into a refrigerant vapor and a weak liquor.

10. The engine system of claim 9, wherein said absorbtion-refrigeration subsystem includes an absorber assembly for combining a flow of said weak liquor and a flow of said refrigerant vapor.

11. A method for providing an improved low-temperature engine system, comprising:

supplying a flow of heat energy input to a low-temperature engine system from a heat energy source;

directing a flow of coolant fluid from an external cooling source;

synthesizing a continuous-flow low temperature heat sink at a selected temperature by effecting heat exchange communication between a flow of an absorbent-refrigerant liquor and the flow of heat energy from the heat energy source and by effecting heat exchange communication between the absorbent-refrigerant liquor and the flow of coolant fluid from the external cooling source, said synthesizing step including providing an absorbtion-refrigeration subsystem;

providing a heat engine having a power turbine and a flow of thermodynamic medium operating across a thermal gradient having a high temperature end in heat exchange communication with the flow of heat energy input and having a low temperature end in heat exchange communication across a condenser with the continuous-flow low temperature heat sink, said thermodynamic medium having a vaporization temperature lower than that of steam at the same pressure and a melting point temperature lower than that of water; and carrying out said heat exchange communication across said condenser between the flow of thermodynamic medium and the continuous-flow low temperature heat sink without the need for providing said flow of coolant fluid to said condenser.

12. The method of claim 11, wherein said synthesizing step alternately combines and separates the flow of absorbent-refrigerant liquor between a flow of liquor richer in solute content and a flow of liquor weaker in solute content.

13. The method of claim 11, wherein said external cooling source is at an ambient temperature and said selected temperature of the low temperature heat sink is at a temperature below said ambient temperature.

14. The method of claim 11, wherein said synthesizing step includes alternately cooling the absorbent-refrigerant liquor for providing the low temperature heat sink and alternately heating the absorbent-refrigerant liquor for providing heat to the circulating thermodynamic medium.

15. The method of claim 11, wherein said flow of refrigerant and said flow of thermodynamic medium interact with each other by heat exchange communication by which the refrigerant absorbs heat and by which said thermodynamic medium loses heat after it leaves the heat engine.

16. The method of claim 11, wherein said flow of refrigerant and said flow of thermodynamic medium interact with each other by heat exchange communication that decreases the temperature of the refrigerant and that increases the temperature of the thermodynamic medium before it enters the heat engine.

17. The method of claim 11, wherein said synthesizing step alternately combines and separates the flow of absorbent-refrigerant liquor between a flow of weak liquor and a flow of strong liquor.

18. The method of claim 11, wherein said synthesizing step includes fractionally distilling the flow of absorbent-refrigerant liquor into a flow of strong refrigerant vapor and a flow of weak liquor.

* * * * *

UNITED STATES PATENT AND TRADEMARK OFFICE

CERTIFICATE OF CORRECTION

PATENT NO. : 4,503,682

DATED : March 12, 1985

INVENTOR(S) : Joel H. Rosenblatt

It is certified that error appears in the above—identified patent and that said Letters Patent is hereby corrected as shown below:

Column 8, line 49, "22° F." should read -- -22° F.--.

Column 8, line 52, "27° F." should read -- -27° F.--.

Column 9, line 6, "75%" should read --75° F.--.

Column 9, line 23, "27.7° F." should read -- -27.7° F.--.

Column 9, line 25, "22° F." should read -- -22° F.--.

Column 9, line 38, "22° F." should read -- -22° F.--.

Column 9, line 51, "22° F." should read -- -22° F.--.

Column 10, line 41, "22.91%" should read --of 22.91%--.

Signed and Sealed this

*Seventeenth* Day of *September 1985*

[SEAL]

*Attest:*

*Attesting Officer*

DONALD J. QUIGG

*Commissioner of Patents and Trademarks—Designate*